US006257406B1

(12) United States Patent
Garino

(10) Patent No.: US 6,257,406 B1
(45) Date of Patent: Jul. 10, 2001

(54) DETACHABLE BASKETBALL HANGER

(75) Inventor: Jerry Garino, Bergenfield, NJ (US)

(73) Assignee: Jerry C. Garino, Bergenfield, NJ (US)

( * ) Notice: Subject to any disclaimer, the term of this patent is extended or adjusted under 35 U.S.C. 154(b) by 0 days.

(21) Appl. No.: 09/523,673

(22) Filed: Mar. 10, 2000

(51) Int. Cl.[7] ..... B65D 85/00

(52) U.S. Cl. ..... 206/315.9; 220/475; 383/13; 383/117

(58) Field of Search ..... 206/315.9, 579; 220/475; 224/919; 248/218.4, 219.4; 383/13, 24, 117; 473/424, 430, 575, 576

(56) References Cited

U.S. PATENT DOCUMENTS

| | | | | |
|---|---|---|---|---|
| 4,147,353 | | 4/1979 | Moore | 473/575 |
| 4,184,707 | | 1/1980 | Nelson | 294/19 |
| 4,193,625 | | 3/1980 | Nelson | 294/19 |
| 5,083,797 | | 1/1992 | Vartija et al. | 473/576 |
| 5,085,320 | * | 2/1992 | Scott | 206/315.9 |
| 5,094,462 | | 3/1992 | Boyle et al. | 473/576 |
| 5,207,360 | * | 5/1993 | Stine | 206/315.9 |
| 5,238,162 | * | 8/1993 | LaCivita | 206/315.9 |
| 5,358,258 | | 10/1994 | Killion | 473/576 |
| 5,443,576 | * | 8/1995 | Hauter | 473/424 |
| 5,647,089 | | 7/1997 | Hollrock | 15/302 |
| 5,669,837 | | 9/1997 | Hauter | 473/576 |
| 5,792,014 | * | 8/1998 | Brown | 473/430 |
| 5,894,951 | | 4/1999 | Hunt | 220/475 |
| 5,909,833 | * | 6/1999 | Smith | 224/919 |

* cited by examiner

*Primary Examiner*—Jim Foster

(57) ABSTRACT

A detachable basketball hanger (10) functioning to hold at least one basketball (22). The detachable basketball hanger (10) having a holder (12). A top strap (14T) is securely attached at a left distal end to the holder right (12R). A bottom strap (14B) is securely attached at a left distal end to the holder right (12R). A first connector (16A) securely affixed to the holder front (12F). A cinch (20) is looped through a top of a ball holder bag (18A) of a ball holder (18) forming a ball holder bag opening (18AA). A second connector (16B) is securely connected to a top end of the cinch (20).

7 Claims, 3 Drawing Sheets

DETACHABLE BASKETBALL HANGER

BACKGROUND OF THE INVENTION

1. Field of the Invention

The present invention relates to a detachable basketball hanger. More particularly, the present invention relates to a detachable basketball hanger for holding basketballs.

2. Description of the Prior Art

Numerous innovations for ball holding devices have been provided in the prior art that are described as follows. Even though these innovations may be suitable for the specific individual purposes to which they address, they differ from the present invention as hereinafter contrasted.

In U.S. Pat. No. 5,894,951, Titled, Basketball storage device , invented by Hunt comprises a basketball storage device (12) for a basket assembly (14) having a stanchion (16) extending upwardly from a court floor (18). A support member (20) on a top end of the stanchion (16). A backboard (22) affixed to the support member (20). A rim (24) attached to the backboard (22) and a net (26) hanging down from the rim (24). The basketball storage device (12) comprises a container (28) for holding at least one basketball (30) therein. A structure (32) is for attaching the container (28) in a vertical position to the stanchion (16) of the basket assembly (14), so that the at least one basketball (30) is available to be utilized in a basketball game.

In U.S. Pat. No. 5,669,837, Titled, Soccer training apparatus, invented by Hauter comprises a soccer training apparatus is provided. The apparatus has a mesh soccer net sized and configured for encapsulating a soccer ball and loosely holding the soccer ball within the mesh soccer net enabling the encapsulated soccer ball to freely rotate within. A waist belt is adapted for securement around a waist of a user. A cord has a first portion attached to the mesh soccer net and a second portion connected to a hand grip. The hand grip is removably connected with the waist belt.

In U.S. Pat. No. 5,647,089, Titled, Apparatus for washing and sorting plastic balls, invented by Hollrock comprises a plastic balls of the type used in recreational trampoline type pits are picked up by a hand held conduit and conveyed pneumatically to a sorting station where out of round balls are culled from the stream of balls to be washed. A golf ball type washer cleans and disinfects the balls, which are then conveyed to a storage bag for reuse in the pit.

In U.S. Pat. No. 5,358,258, Titled, Apparatus for soccer training , invented by Killion comprises a soccer training device is described that attaches a soccer ball to a user through a flexible tether line. An adjustable belt encircles the waist of the user and attaches to one end of the elastic tether line. The other end of the tether line is attached to a girdle made of elastic sheet material that encircles the soccer ball. Certain features of the girdle allow it to hold the ball firmly while, simultaneously, provide proper tactile feedback to the user when kicking the ball. Several novel soccer training exercises useful with the present invention are described.

In U.S. Pat. No. 5,094,462, Titled, Soccer training device, invented by Boyle, et. al. comprises a soccer training device including a soccer ball located within a net. The net is attached to one end of a bungee cord and the other end of the bungee cord is attached to a strap which is placed about a person's wrist or ankle. The person kicks the ball within the net and by having the strap fastened to his limb the ball is propelled away from the person and then returned to his vicinity allowing the person to play soccer by himself.

In U.S. Pat. No. 5,083,797, Titled, Game ball training apparatus/carrier, invented by Vartija, et. al. comprises a game ball assembly for use with a game ball is described comprising a net for receiving and holding the game ball, a handle adapted to be retained within a user's hand, a length adjuster having a body part and a relatively movable locking slide part defining with said body part two paths at opposite sides of the slide part, and an elongated substantially inelastic tether cord or rope secured between the handle and the net. The tether extends through one of the paths of the length adjuster, through the net and then through the other path of the length adjuster such that a free end of the tether is supported between the slide part and the body part of the length adjuster. This arrangement facilitates simple adjustment of the length of the tether.

In U.S. Pat. No. 4,193,625, Titled, Basketball storage device , invented by Nelson is a Ball retrieving and storage bag comprises an apparatus to assist in retrieving tennis balls and in storing tennis balls. The apparatus comprises a bottom frame through which a tennis ball may pass upwardly when the bottom frame is positioned over the tennis ball and pressed firmly to the ground and which frame prevents the tennis ball passing downwardly and out of the frame by means of gravitational force. There is positioned above the frame a storage bag for storing tennis balls.

In U.S. Pat. No. 4,184,707, Titled, Ball retrieving and storage bag, invented by Nelson, et. al. comprises an apparatus to assist in retrieving balls and in storing balls, such as tennis balls. The apparatus comprises a bottom frame through which a ball may pass upwardly when the bottom frame is positioned over the ball and pressed firmly to the ground and which frame prevents the ball passing downwardly and out of the frame by means of gravitational force. There is positioned above the frame a storage bag for storing balls.

In U.S. Pat. No. 4,147,353, Titled, Basketball storage device , invented by Moore comprises an apparatus for holding and retrieving a game ball includes a suitable anchor with a cord attached to the anchor at one end and an adjustable ball holder attached to the other end of the cord. The adjustable ball holder has four elongated pieces of webbing material that are joined together at one end so that the pieces extend outwardly at right angles between each adjacent piece of webbing material. The webbing material pieces are sized to extend around a game ball with the upper free ends of the webbing being attached to the other end of the elongated cord to thereby hold the ball in place. A continuous elastic strip is attached to the mid-point of each of the webbing material pieces to thereby surround the ball held in place to allow balls of different sizes to be held within the ball holder.

The above patented inventions differ from the present invention because they fail to describe or claim at least one combination of the following features depicted in the present invention: a holder having a holder back hook, top strap, bottom strap, first connector, second connector, ball holder and cinch.

Numerous innovations for detachable basketball hangers have been provided in the prior art that are adapted to be used. Even though these innovations may be suitable for the specific individual purposes to which they address, they would not be suitable for the purposes of the present invention as heretofore described.

SUMMARY OF THE INVENTION

The present invention relates to a detachable basketball hanger. More particularly, the present invention relates to a detachable basketball hanger for holding basketballs.

The types of problems encountered in the prior art are basketballs are scattered all over after use.

In the prior art, unsucessful attempts to solve this problem were attempted namely: canisters and bags. However, the problem was solved by the present invention because it is a bag which is removably attachable to a basketball pole.

Innovations within the prior art are rapidly being exploited in the field of sporting goods.

The present invention went contrary to the teaching of the art which describes and claims canisters and bags.

The present invention solved a long felt need for a removable basketball pole attachable holding device.

The present invention produced unexpected results namely: the basket balls lasted longer because they were hanging up from the ground.

Accordingly, it is an object of the present invention to provide a detachable basketball hanger having a holder, top strap, bottom strap, first connector, second connector, ball holder, and cinch.

More particularly, it is an object of the present invention to provide the holder having a holder bottom, holder front, holder top, holder back with holder back hook, holder right, and holder left.

In keeping with these objects, and with others which will become apparent hereinafter, one feature of the present invention resides, briefly stated, in the top strap having a top strap hook, top strap loop, and top strap ring.

When the bottom strap is designed in accordance with the present invention, bottom strap hook, bottom strap loop, and bottom strap ring.

In accordance with another feature of the present invention, ball holder having ball holder bag with ball holder bag opening.

Another feature of the present invention is that the cinch having cinch closer and cinch strap.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawings.

List of Reference Numerals Utilized in the Drawings

10—detachable basketball hanger (10)
12—holder (12)
12A—holder bottom (12A)
12F—holder front (12F)
12T—holder top (12T)
12B—holder back (12B)
12BA—holder back hook (12BA)
12R—holder right (12R)
12L—holder left (12L)
14T—top strap (14T)
14TA—top strap hook (14TA)
14TB—top strap loop (14TB)
14TC—top strap ring (14TC)
14B—bottom strap (14B)
14BA—bottom strap hook (14BA)
14BB—bottom strap loop (14BB)
14BC—bottom strap ring (14BC)
16A—first connector (16A)
16B—second connector (16B)
18—ball holder (18)
18A—ball holder bag (18A)
18AA—ball holder bag opening (18AA)
20—cinch (20)
20A—cinch closer (20A)
20B—cinch strap (20B)
22—basketball (22)
24—basketball pole (24)

DESCRIPTION OF THE PREFERRED EMBODIMENT

Figure 1:
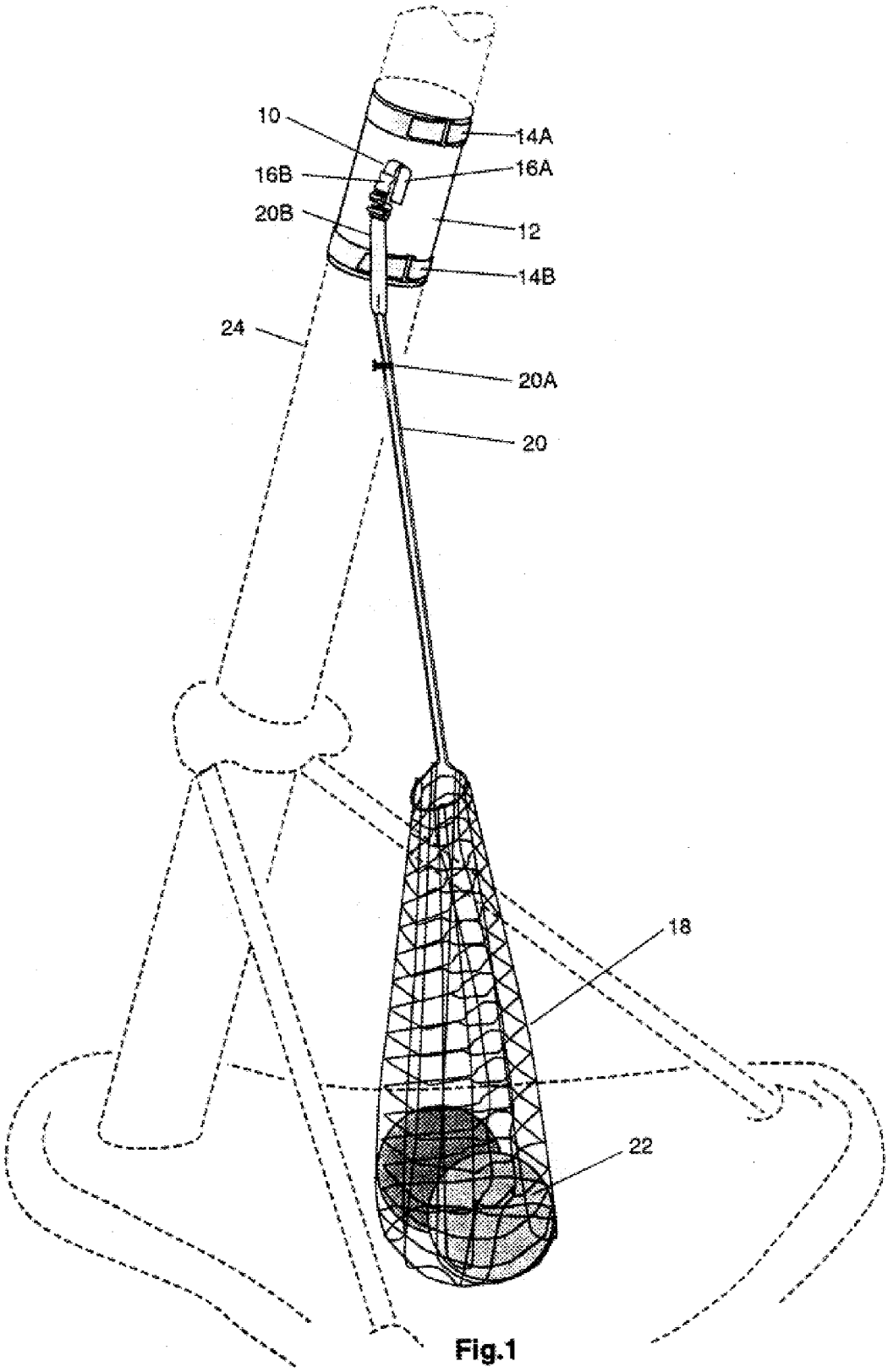
FIG. 1 is a front view of a detachable basketball hanger (10) attached to a basketball pole (22).

Firstly, referring to FIG. 1 which is a front view of a detachable basketball hanger (10) attached to a basketball pole (22). The detachable basketball hanger (10) functions to hold at least one basketball (22). The detachable basketball hanger (1O) comprises a holder (12) which comprises a holder bottom (12A), holder front (12F), holder top (12T), holder right (12R), holder left (12L) and a holder back (12B).

Figure 2:
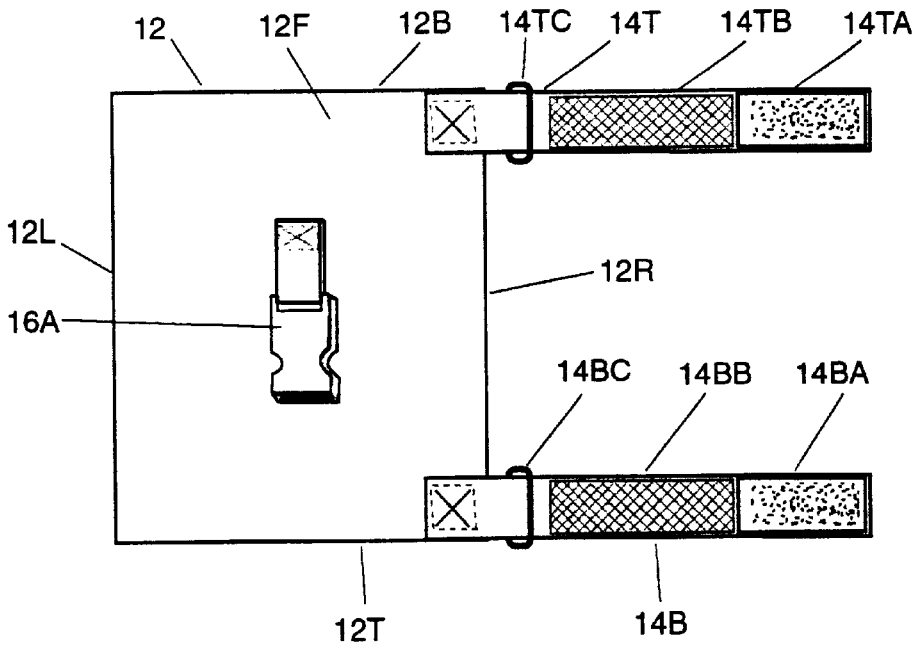
FIG. 2 is a front view of a holder (12).

Referring to FIG. 2 which is a front view of a holder (12). The detachable basketball hanger (10) comprises a holder (12) which further comprises a top strap (14T) securely attached at a left distal end to the holder right (12R). The top strap (14T) comprises top strap hook (14TA) positioned at a right distal end and top strap loop (14TB) positioned in a middle of the top strap (14T). A top strap ring (14TC) is securely attached to a left side of the top strap (14T).

The detachable basketball hanger (1O) comprises a holder (12) which further comprises a bottom strap (14B) securely attached at a left distal end to the holder right (12R). The bottom strap (14B) comprises bottom strap hook (14BA) positioned at a right distal end and bottom strap loop (14BB) positioned in a middle of the bottom strap (14B). A bottom strap ring (14BC) is securely attached to a left side of the bottom strap (14B).

The detachable basketball hanger (1O) comprises a holder (12) which further comprises a first connector (16A) securely affixed to the holder front (12F).

Figure 4:
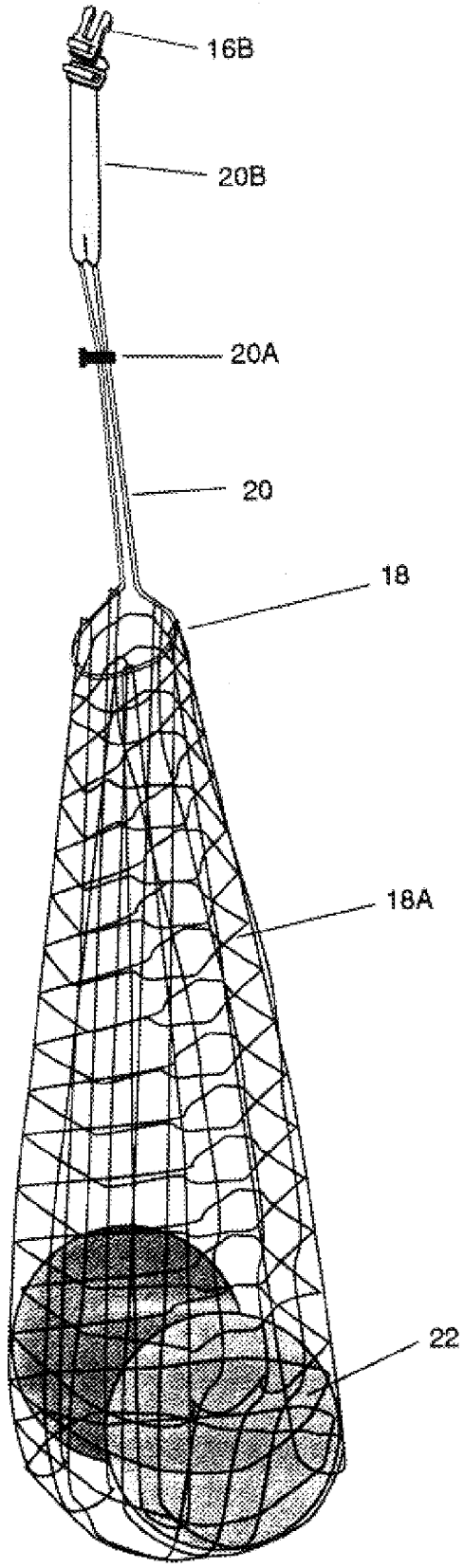
FIG. 4 is a front view of a ball holder (18).

Referring to FIG. 4 is a front view of a ball holder (18). A cinch (20) is looped through a top of a ball holder bag (18A) of a ball holder (18) forming a ball holder bag opening (18AA). A second connector (16B) is securely connected to a top end of the cinch (20). The second connector (16B) is removably attachable to the first connector (16A). The cinch (20) comprises a cinch closer (20A) slidable mounted thereon. The cinch (20) further comprises a cinch strap (20B) is securely attached to a top end of the cinch (20) functioning to securely connect the cinch (20) top the second connector (16B). The ball holder bag (18A) is preferably a net.

Figure 3:
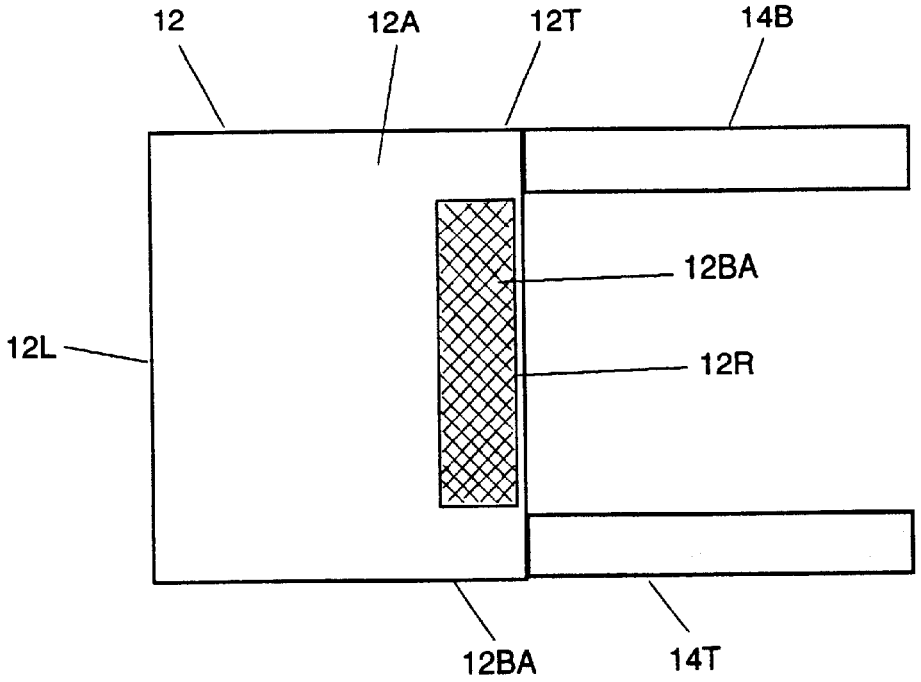
FIG. 3 is a back view of a holder (12).

Referring to FIG. 3 which is a back view of a holder (12). The holder back (12A) comprises hook material affixed thereon. The holder back (12A) further comprises holder back hook (12BA) securely attached along a right edge thereof functioning to affix the holder (12) around the basketball pole (24) while a user is securing the top strap (14T) and bottom strap (14B).The holder (12) is manufactured from a material selected from a group consisting of rubber, rubber composite, neoprene, plastic, plastic composite, natural fibers, and synthetic fibers.

It will be understood that each of the elements described above, or two or more together, may also find a useful application in other types of constructions differing from the type described above.

While the invention has been illustrated and described as embodied in a detachable basketball hanger, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claims:

What is claimed is:

1. A detachable basketball hanger (10) functioning to hold at least one basketball (22), the detachable basketball hanger (10) comprising:

A) a holder (12) which comprises a holder bottom (12A), holder front (12F), holder top (12T), holder right (12R), holder left (12L) and a holder back (12B);

B) a top strap (14T) is securely attached at a left distal end to the holder right (12R), the top strap (14T) comprises top strap hook (14TA) positioned at a right distal end and top strap loop (14TB) positioned in a middle of the top strap (14T), a top strap ring (14TC) is securely attached to a left side of the top strap (14T);

B) a bottom strap (14B) is securely attached at a left distal end to the holder right (12R), the bottom strap (14B) comprises bottom strap hook (14BA) positioned at a right distal end and bottom strap loop (14BB) positioned in a middle of the bottom strap (14B), a bottom strap ring (14BC) is securely attached to a left side of the bottom strap (14B);

C) a first connector (16A) securely affixed to the holder front (12F); and D) a cinch (20) looped through a top of a ball holder bag (18A) of a ball holder (18) forming a ball holder bag opening (18AA), a second connector (16B) is securely connected to a top end of the cinch (20).

2. The detachable basketball hanger (10) as described in claim 1, wherein the cinch (20) comprises a cinch closer (20A) slidable mounted thereon.

3. The detachable basketball hanger (10) as described in claim 1, wherein the cinch (20) further comprises a cinch strap (20B) securely attached to a top end of the cinch (20) functioning to securely connect the cinch (20) top.

4. The detachable basketball hanger (10) as described in claim 1, wherein the holder (12) is manufactured from a material selected from a group consisting of rubber, rubber composite, neoprene, plastic, plastic composite, natural fibers, and synthetic fibers.

5. The detachable basketball hanger (10) as described in claim 1, wherein the holder back (12A) comprises hook material affixed thereon.

6. The detachable basketball hanger (10) as described in claim 1, wherein the holder back (12A) further comprises holder back hook (12BA) securely attached along a right edge thereof functioning to affix the holder (12) around the basketball pole (24) while a user is securing the top strap (14T) and bottom strap (14B).

7. The detachable basketball hanger (10) as described in claim 1, wherein the ball holder bag (18A) is a net.

* * * * *